US009356390B2

(12) United States Patent
Annis et al.

(10) Patent No.: US 9,356,390 B2
(45) Date of Patent: May 31, 2016

(54) LATCH ASSEMBLIES FOR CONNECTOR SYSTEMS

(71) Applicant: Tyco Electronics Corporation, Berwyn, PA (US)

(72) Inventors: Kyle Gary Annis, Hummelstown, PA (US); Kevin Michael Thackston, York, PA (US); Matthew Richard McAlonis, Elizabethtown, PA (US); Albert Tsang, Harrisburg, PA (US); Dustin Carson Belack, Hummelstown, PA (US); Nicholas Paul Ruffini, York, PA (US); Chong Hun Yi, Mechanicsburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/708,863

(22) Filed: May 11, 2015

(65) Prior Publication Data

US 2015/0333441 A1 Nov. 19, 2015

Related U.S. Application Data

(60) Provisional application No. 61/996,782, filed on May 14, 2014.

(51) Int. Cl.
*H01R 13/44* (2006.01)
*H01R 13/627* (2006.01)
(Continued)

(52) U.S. Cl.
CPC ..... *H01R 13/6272* (2013.01); *H01R 13/62905* (2013.01); *H01R 13/62911* (2013.01);
(Continued)

(58) Field of Classification Search
CPC ..... H01R 13/6272; H01R 13/62911; H01R 13/6335; H01R 13/62977; H01R 13/635; H01R 13/62905; H01R 13/639; H01R 13/62961; H01R 13/4365; H01R 13/62927; H01R 43/26
USPC ..... 439/133
See application file for complete search history.

(56) References Cited

U.S. PATENT DOCUMENTS 5,478,251 A * 12/1995 Jaklin ..... H01R 13/62911 439/157
5,618,195 A * 4/1997 Cappe ..... H01R 13/4365 439/157

(Continued)

FOREIGN PATENT DOCUMENTS

DE 197 21 444 A1 12/1997
DE 198 37 896 A1 2/2000

(Continued)

OTHER PUBLICATIONS

European Search Report, Mail Date, Oct. 2, 2015, EP 15 16 7728, Application No. 15167728.3-1801.

*Primary Examiner* — Jean F Duverne

(57) ABSTRACT

A connector system includes a cartridge having at least one cavity configured to hold connector modules therein. The connector system also includes at least one slider latch housed in the cartridge. The at least one slider latch is movable in a longitudinal direction and has at least one groove configured to receive a cam of a corresponding connector module to secure the connector modules to the cartridge. The at least one slider latch has a biasing member operably coupled thereto. The biasing member biases the slider latch in a biasing direction. The biasing member forces the at least one slider latch to return to a latched position after the cam is received in the profiled groove. The connector system also includes a discharge mechanism configured to move a discharge slider.

20 Claims, 10 Drawing Sheets

(51) Int. Cl.

| | |
|---|---|
| ***H01R 13/629*** | (2006.01) |
| ***H01R 13/639*** | (2006.01) |
| ***H01R 13/635*** | (2006.01) |
| *H01R 13/633* | (2006.01) |

(52) U.S. Cl.
CPC ..... *H01R13/62961* (2013.01); *H01R 13/635* (2013.01); *H01R 13/639* (2013.01); *H01R 13/62977* (2013.01); *H01R 13/6335* (2013.01)

(56) References Cited

U.S. PATENT DOCUMENTS

| | | | | |
|---|---|---|---|---|
| 5,871,363 | A | 2/1999 | Kimura | |
| 5,876,226 | A * | 3/1999 | Tsukakoshi ..... | H01R 13/62927 439/157 |
| 6,036,509 | A | 3/2000 | Maejima | |
| 7,097,476 | B2 * | 8/2006 | Morikawa ..... | H01R 13/62911 439/157 |
| 7,335,037 | B2 * | 2/2008 | Razafiarivelo ... | H01R 13/62911 439/157 |
| 8,025,512 | B2 * | 9/2011 | Aoki ..... | H01R 43/26 439/157 |
| 2005/0020114 | A1 | 1/2005 | Denter et al. | |
| 2011/0260745 | A1 | 10/2011 | Naitou | |
| 2013/0337671 | A1 | 12/2013 | Tsang et al. | |

FOREIGN PATENT DOCUMENTS

| | | | |
|---|---|---|---|
| DE | 10 2011 005508 | A1 | 9/2012 |
| EP | 0 549 371 | A2 | 6/1993 |
| EP | 0 655 799 | A1 | 5/1995 |
| EP | 0 713 270 | A2 | 5/1996 |
| EP | 0 984 524 | A2 | 3/2000 |
| FR | 2 860 650 | A1 | 4/2005 |
| GB | 2 318 925 | A | 5/1998 |
| JP | H10 41007 | A | 2/1998 |
| JP | 2006 331991 | A | 12/2006 |
| WO | 2006/087097 | A1 | 8/2006 |

* cited by examiner

LATCH ASSEMBLIES FOR CONNECTOR SYSTEMS

CROSS REFERENCE TO RELATED APPLICATIONS

This application claims the benefit of U.S. Provisional Application No. 61/996,782 filed May 14, 2014 of the same title, the subject matter of which is herein incorporated by reference in its entirety.

BACKGROUND OF THE INVENTION

The subject matter herein relates generally to latch assemblies for connector systems.

Connector systems typically include electrical connectors and mating electrical connectors configured to be mated with corresponding electrical connectors. In some applications, the electrical connectors are part of a backplane. The electrical connectors are coupled to the backplane and positioned for mating with the mating electrical connectors. The electrical connectors may be mounted to the backplane.

Current retention methods include designs with screws that secure the electrical connectors to the backplane. Such retention methods require tools to assemble and unassemble, which is time consuming. Also, loosening of the screws due to vibration is another potential problem. Other retention methods introduce release mechanisms to secure the electrical connectors to the backplane. But those retention methods typically allow a single module to be connected or released from the backplane at a time.

A need remains for a mechanism to retain an electrical connector to a surface in such a way to create a simple interface. A need remains for a tool-less means of attaching electrical connectors to a backplane.

BRIEF DESCRIPTION OF THE INVENTION

In one embodiment, a connector system is provided including a cartridge having at least one cavity configured to hold connector modules therein. The cartridge has at least one port therein. The cartridge receives the connector modules through the corresponding at least one port. The connector system also includes at least one slider latch housed in the cartridge. The at least one slider latch is movable in a longitudinal direction and has at least one groove configured to latchably receive a cam of the corresponding connector module to secure the connector modules to the cartridge. The at least one slider latch has a biasing member operably coupled thereto. The biasing member biases the at least one slider latch in a biasing direction. The biasing member forces the at least one slider latch to return to a latched position after the cam is received in the profiled groove. The connector system also includes at least one disengage slider operably connected to a corresponding slider latch. Movement of the disengage slider forces the slider latch to move from the latched position to a disengage position to release the cam from the corresponding profiled groove to eject each of the connector modules from the cartridge. The connector system also includes a discharge mechanism configured to move the discharge slider.

In another embodiment, a connector system is provided including one or more connector modules having a housing including one or more stations configured to hold a harness key at a plurality of locations. The connector system also includes a cartridge having at least one cavity configured to hold connector modules therein. The cartridge has at least one port therein. The port has a keyway configured to receive the harness key. The cartridge receiving the connector modules through the corresponding at least one port. The connector system also includes at least one slider latch housed in the cartridge. The at least one slider latch is movable in a longitudinal direction and has at least one profiled groove configured to latchably receive a cam of the corresponding connector module to secure the connector modules to the cartridge. The at least one slider latch as a biasing member operably coupled thereto. The biasing member biasing the at least one slider latch in a biasing direction. The biasing member forcing the at least one slider latch to return to a latch position after the cam is received in the profiled groove. The connector system also includes at least one disengage slider operably connected to the corresponding slider latch. Movement of the disengage slider forces the slider latch to move from the latched position to a discharge position to release the cam from the corresponding profiled groove to eject each of the connector modules from the cartridge. The connector system also includes a discharge mechanism configured to move the discharge slider.

In another embodiment, a connector system is provided including a cartridge having at least one cavity configured to hold connector modules therein. The cartridge has at least one port therein. The cartridge receives the connector modules through the corresponding at least one port. The connector system includes at least one slider latch housed in the cartridge. The at least one slider latch is movable in a longitudinal direction and has at least one profiled groove configured to latchably receive a cam of the corresponding connector module to secure the connector module to the cartridge. The at least one slider latch has a biasing member operably coupled thereto. The biasing member biasing the at least one slider latch in a biasing direction. The biasing member forcing the at least one slider latch to return to a latched position after the cam is received in the profiled groove. The profiled groove includes a latching area in which the cam is captured to secure the connector module. The profiled groove includes inclined surfaces to guide the cam into the groove. The connector system also includes at least one disengage slider operably connected to a corresponding slider latch. Movement of the disengage slider forces the slider latch to move from the latched position to a discharge position to release the cam from the corresponding profiled groove to eject each of the connector modules form the cartridge. The connector system also includes a discharge mechanism configured to move the discharge slider.

DETAILED DESCRIPTION OF THE INVENTION

Figure 1:
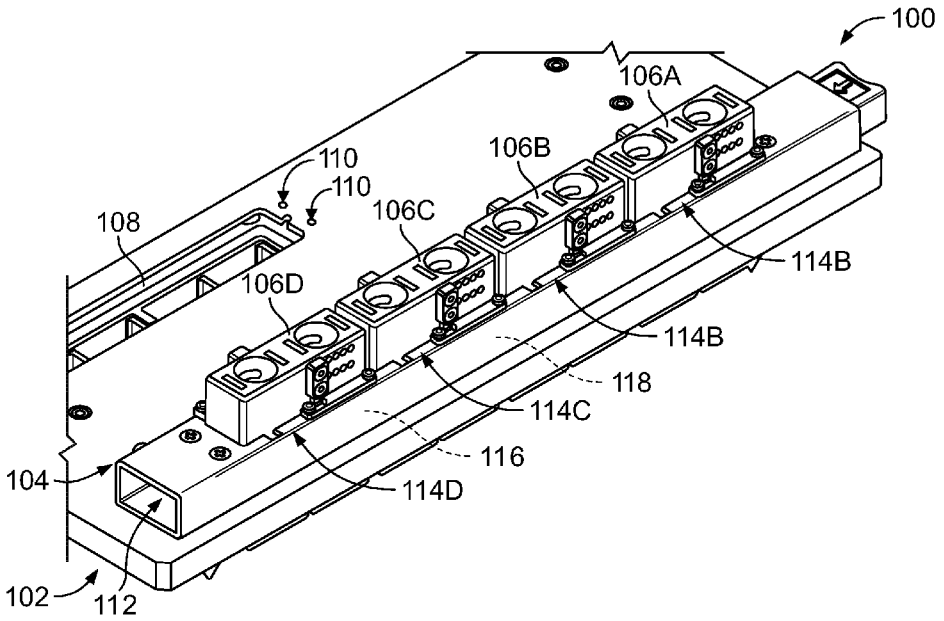
FIG. 1 is a front perspective view of a connector system formed in accordance with an embodiment.

FIG. 1 is a front perspective view of a connector system 100 formed in accordance with an exemplary embodiment. The connector system 100 includes a backplane assembly 102 having a cartridge 104 mounted thereto. The cartridge 104 is configured to hold at least one connector module 106 therein. The connector modules 106 are configured to be electrically connected to corresponding mating electrical connectors (not shown) in the backplane assembly 102 as part of a network system, a server, or other type of system. For example, the mating electrical connectors may be part of a daughter card or a printed circuit board (PCB) 108 that is made into the backplane assembly 102.

The backplane assembly 102 includes a plurality of openings 110. The cartridge 104 is coupled to the backplane assembly 102 and is used to couple the connector modules 106 to the backplane assembly 102. The cartridge 104 may be coupled to the backplane assembly 102 using fasteners (not shown) that extend into and/or through the openings 110.

The connector modules 106 may be any type of connectors. The connector modules 106 may include a plurality of contacts or terminals that are configured to be mated to corresponding contacts or terminals of the mating electrical connectors. The contacts or terminals may be terminated directly to the backplane PCB 108 or the daughtercard (not shown) of the backplane assembly 102, such as by surface mounting or through hole mounting to the backplane assembly 102. Alternatively, the contacts or terminals may be terminated to ends of wires of the cables of the cable mounted electrical connectors. The contacts of terminals may be any types of contacts or terminals, such as pins, sockets, blades, tuning forks, plugs, receptacles, and the like. The electrical connectors may be fiber optic connectors in alternative embodiments.

The cartridge 104 includes at least one cavity 112 configured to hold the connector modules 106 therein. The cavity 112 includes at least one port 114 sized and shaped to receive one of the connector modules 106. The at least one port 114 is open to the backplane assembly 102 such that the connector modules 106 travel to and through the port 114 to be received in the backplane assembly 102. In the illustrated embodiment, the cavity 112 has four ports 114*a*, 114*b*, 114*c*, and 114*d*, each holding a corresponding connector module 106*a*, 106*b*, 106*c*, and 106*d* therein. In other embodiments, the cavity 112 may include more or fewer ports 114.

The connector system 100 includes at least one slider latch 116 (also shown in FIG. 5) housed within the cavity 112 of the cartridge 104. The slider latch 116 is movable in a longitudinal direction indicated by the arrows A and B. The slider latch 116 secures a portion of the connector module 106 to the cartridge 104 to engage the connector module 106 with the mating electrical connectors in the backplane assembly 102 or daughtercard (not shown). At least one disengage slider 118 (also shown in FIG. 5) is operably connected to the slider latch 116 to eject or disengage the connector module 106 from the cartridge 104. In an exemplary embodiment, the cartridge 104 allows for quick connection and quick disconnection of the connector module 104 form the backplane assembly 102. For example, the cartridge 104 may concurrently disengage or eject one or more of the connector modules 106 held in each of the ports 114. As such, the connector module 106 is capable of being coupled to the cartridge 104 without the use of threaded fasteners or other types of connectors or fasteners that are time consuming to attach and detach.

Figure 2:
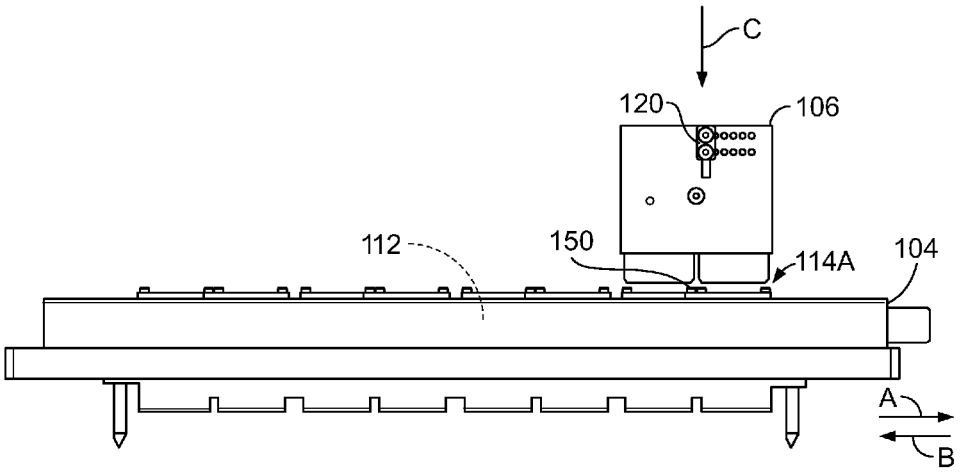
FIG. 2 is a side view of a connector module poised for mounting to a cartridge formed in accordance with an embodiment.

FIG. 2 is a side view of the connector module 106 poised for mounting to the cartridge 104. As illustrated, the connector module 106 is aligned with the port 114*a* and is poised to be inserted into the cavity 112 to be coupled to the cartridge 104. The connector module 106 is inserted into the port 114*a* in a mating direction indicated by the arrow C that is generally perpendicular to the longitudinal movement of the slider latch 116 (shown in FIG. 5) indicated by the arrows A and B. As is discussed below, the connector module 106 includes one or more harness keys 120 configured pass through a keyway 150 in the cartridge 104 to allow the connector module 106 to be received in select ports 114.

Figure 3:
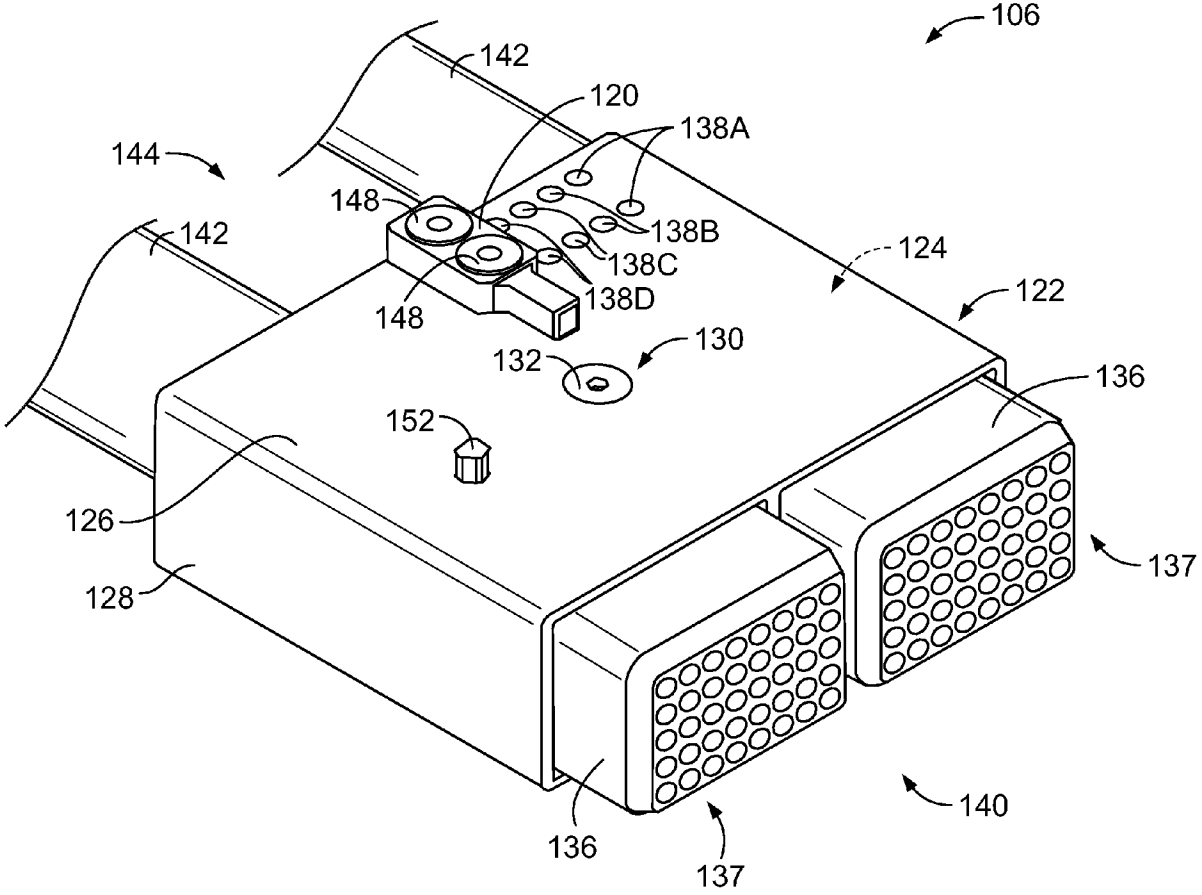
FIG. 3 is a front perspective view of a connector module formed in accordance with an embodiment.
Figure 4:
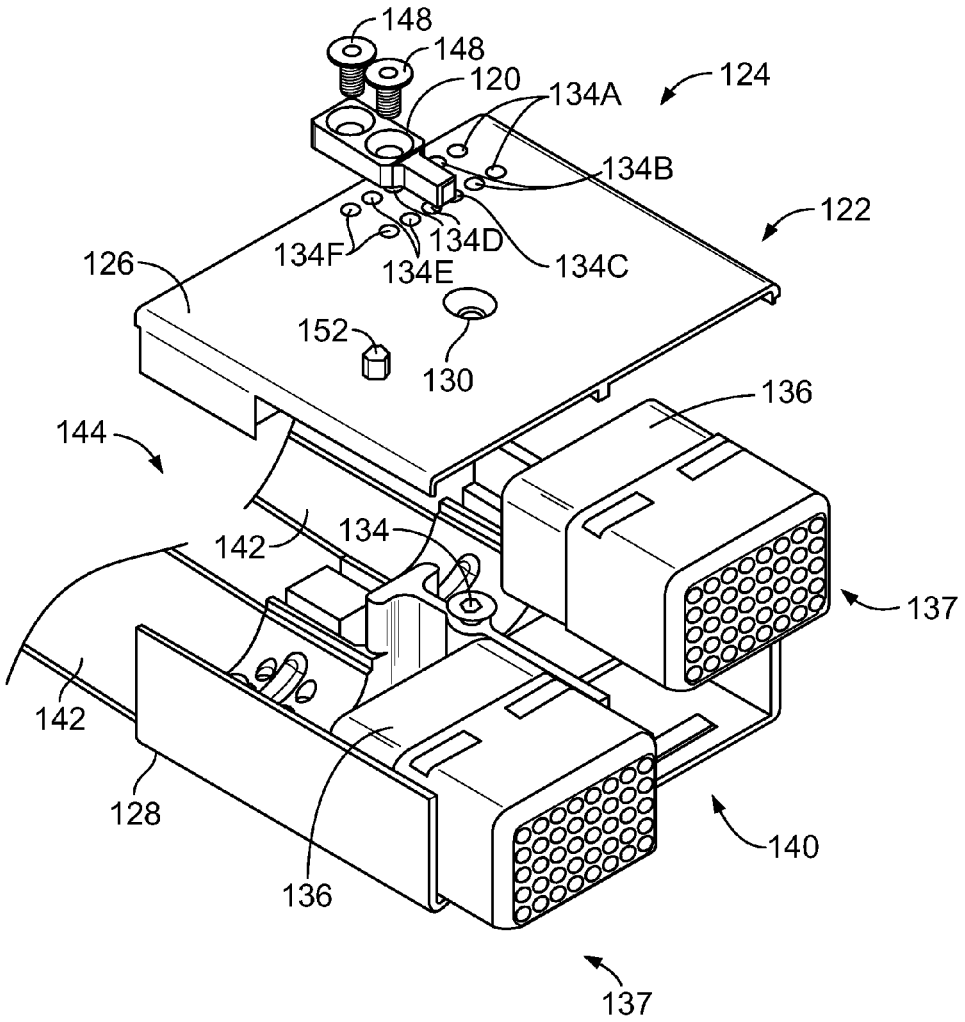
FIG. 4 is an exploded perspective view of a connector module formed in accordance with an embodiment.

FIG. 3 is a front perspective view of the connector module 106. FIG. 4 is an exploded perspective view of the connector module 106.

The connector module 106 includes a housing 122 having a cavity 124 therein. The housing 122 may include a top shell 126 and a bottom shell 128. The top and bottom shells 126, 128 may be coupled to one another using a snap-fit and/or other securing means. In the illustrated embodiment, the top shell 126 includes an opening 130 sized and shaped to receive a threaded fastener 132 (shown in FIG. 3) therethrough. The bottom shell 128 includes a threaded receiver 134 (shown in FIG. 4) that is aligned with the opening 130 and configured to receive the threaded fastener 132. In other embodiments, other arrangements are possible. For example, the housing 122 may be split along a front shell and a back shell.

The housing 122 holds a plurality of electrical connectors 136 within the cavity 124. Any number of electrical connectors 136 may be held in the housing 122 depending on the particular application. The electrical connectors 136 electrically and mechanically couple to the mating electrical connectors of the backplane assembly 102 (shown in FIG. 1) when the connector module 106 is mated with the cartridge 104 (shown in FIG. 1). The electrical connectors 136 include mating ends 137 extending beyond a front 140 of the housing 122. The mating ends 137 extend into the backplane assembly 102 (shown in FIG. 1) for mating with the corresponding mating connectors. The electrical connectors 136 include cables 142 that extend beyond a back 144 of the housing 122. In an exemplary embodiment, the cables 142 terminate to another electrical device that may be electrically joined to the backplane assembly 102 (shown in FIG. 1) or daughtercard when the connector module 106 is mated with the cartridge 104 (shown in FIG. 1). In certain embodiments, the electrical connectors 136 may be configured to carry electrical signals, electrical power, and/or the like. In other embodiments, cables 142 may be configured as fiber optic cables and the electrical connectors 136 may be configured to carry optical signals.

The housing 122 includes one or more stations 138 configured to hold the harness key 120. The stations 138 allow the harness key 120 to be coupled to the housing 122 at various locations. The harness key 120 may be positioned one of the stations 138. The harness key 120 may be reconfigurably attached to one of the stations 138 such that the harness key 120 may be removed and replaced in a different station 138. In the illustrated embodiment, the housing 122 includes six stations 138*a*, 138*b*, 138*c*, 138*d*, 138*e*, 138*f* each configured to receive one or more threaded fasteners 148. The harness key 120 may be secured to any of the stations 138 using the threaded fasteners 148. As shown in FIG. 3, the harness key 120 is coupled to the station 138*f*. In other embodiments, other securing means may be used. Although the harness key 120 and stations 138 are shown on the top shell 126, the bottom shell 128 may include a similar arrangement. Optionally, the top shell 126 may include more than one harness key 120 and stations 138. For example, the top shell 126 may be sized and shaped differently than the bottom shell 128. The one or more harness key 120 and stations 138 may both be held on the top shell 126. In other embodiments, other arrangements are possible.

Figure 5:
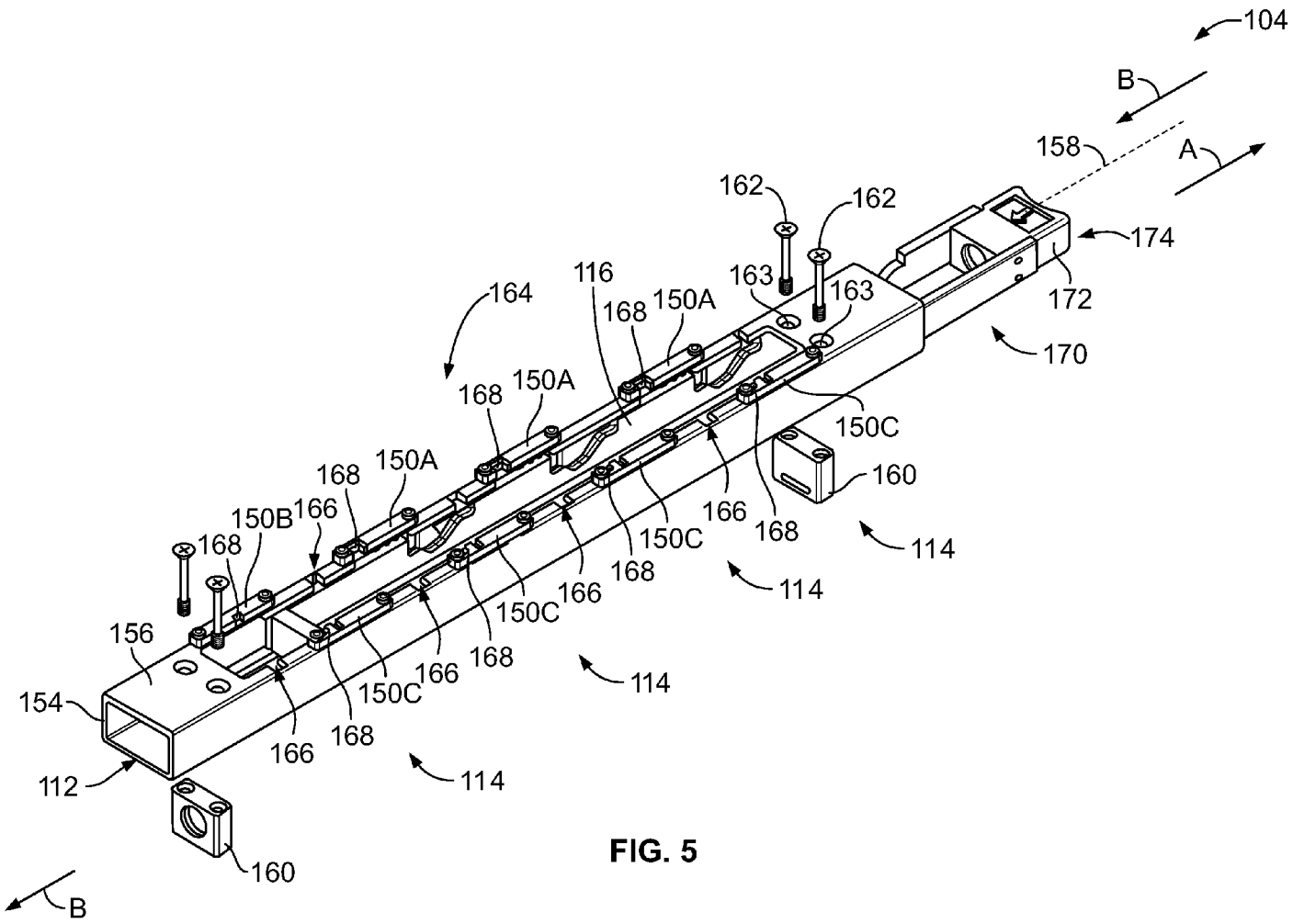
FIG. 5 is an exploded perspective view of a cartridge formed in accordance with an embodiment.

The harness key 120 is sized and shaped to be paired with the keyway 150 (shown in FIG. 5) on the cartridge 104 (shown in FIG. 5). In an exemplary embodiment, the harness key 120 and the keyway 150 allow a particular connector module 106 to be received only in particular ports 114 (shown in FIG. 5). Optionally, the harness key 120 and the keyway 150 allow a particular connector module 106 to be mated with a particular port 114 in a predetermined orientation. Accordingly, the connector module 106 may be inserted into the port 114 in a fixed orientation such that the harness key 120 aligns with the keyway 150. The harness key 120 may provide guidance during mating and may have a lead-in to facilitate mating.

The connector module 106 includes cams 152 extending from the housing 122. In an exemplary embodiment, both the top shell 126 and the bottom shell 128 include the cams 152. The cams 152 interact with the slider latches 116 (shown in FIG. 5) to secure the connector modules 106 within the cartridge 104.

FIG. 5 is an exploded perspective view of the cartridge 104. The cartridge 104 includes a base mount 154 having a cavity 112 therein. The base mount 154 includes an alignment surface 156 thereon. In the illustrated embodiment, the cavity 112 extends through the base mount 154. The base mount 154 may have a generally rectangular cross section.

The slider latches 116 are housed within cavity 112. The slider latches 116 are operably connected to the disengage sliders 118. The slider latches 116 and the disengage sliders 118 are movable within the base mount 154 in a longitudinal direction indicated by the arrows A and B along a longitudinal axis 158 of the cartridge 104.

One or more cartridge spacers 160 may be used to hold the slider latches 116 within the cavity 112. Threaded fasteners 162 extends to and through openings 163 the base mount 156.

The alignment surface 156 is part of the base mount 154. The alignment surface 156 includes an opening 164 therethrough that provides access to the slider latches 116. One or more of the connector module 106 (shown in FIG. 1) are configured to be loaded into the cartridge 104 through the opening 164. The opening 164 includes the ports 114 therein. The alignment surface 156 aligns the connector module 106 (shown in FIG. 1) with the port 114 when the connector module 106 is inserted into the cavity 112.

The alignment surface 156 includes cutouts 166 in the opening 164. The cutouts 166 are configured to receive the corresponding cams 152 (shown in FIG. 2) therethrough as the connector module 106 is loaded into one of the ports 114 of the base mount 154. Each port 114 is configured to receive one of the cartridge assemblies 104. Each port 114 includes one or more of the cutouts 166. The cutouts 166 are aligned with the cams 152. In the illustrated embodiment, the cutouts 166 are offset across the opening 164. However, in other embodiments, the cutouts 166 may be aligned across the opening 164. Having the cutouts 166 offset provides a way of polarizing the mating of the connector module 106 with the port 114. For example, the cutouts 166 may be positioned such that the connector module 106 may be loaded into the port 114 in only one way.

The cartridge 104 includes at least one of the keyways 150 at each port 114. The keyways 150 include a void 168 sized and shaped to allow the harness key 120 to pass therethrough. The void 168 may be positioned along a length of the keyway 150 to correspond to one of the stations 138 (shown in FIG. 3 and FIG. 4). For example, the keyways 150*a* are configured to receive a harness key 120 positioned in the first station 138*a* (shown in FIG. 3). The keyway 150*b* is configured to receive a harness key 120 positioned in the fourth station 138*d* (shown in FIG. 3). The keyways 150*c* are configured to receive a harness key 120 position in the sixth station 138*f* (shown in FIG. 3). In this manner, the keyways 150 are configured to be paired with one of the harness key 120 at one of the stations to govern access to the port 114 by the connector module 106 (shown in FIG. 1).

The cartridge 104 includes a discharge mechanism 170 configured to move the disengage sliders 118. In the illustrated embodiment, the discharge mechanism 170 includes an ejector button 172 operably coupled to the disengage sliders 118 to move the disengage sliders 118 along the longitudinal axis 158 when the ejector button 172 is pressed. In other embodiments, other arrangements are possible. The ejector button 172 has an actuation end 174 that is configured to be located outside of the base mount 154 to be pressed by an operator to release the slider latch 116. The ejector button 172 may be pressed in the direction indicated by the arrow B along the longitudinal axis 158 to move the disengage sliders 118 form a latched position to a discharge position to eject the connector module 106 (shown in FIG. 1).

The cartridge 104 retains the connector module 106 (shown in FIG. 1). The cartridge 104 provides a simple interface for securing the connector module 106 within one of the ports 114 and ejecting the connector module 106 on demand. The cartridge 104 secures the connector module 106 without the need for tools or separate fasteners. In an exemplary embodiment, the cartridge 104 can be operated with one hand to eject the connector module 106. In an exemplary embodiment, the cartridge 104 can be actuated to concurrently eject a plurality of the connector modules 106 held in each port 114. The cartridge 104 is narrow and allows the connector modules to be stacked side by side in a tight pitch.

Figure 6:
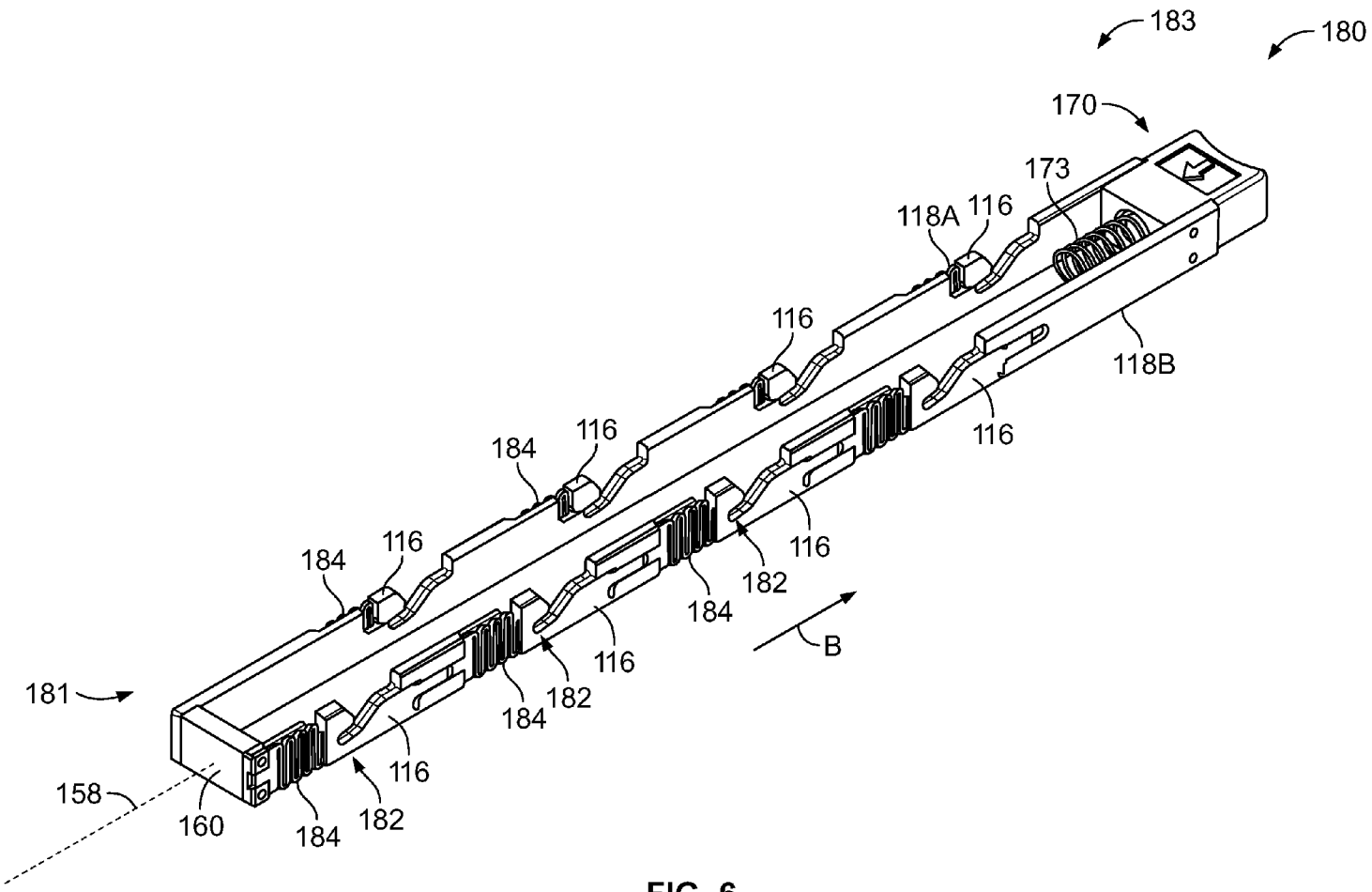
FIG. 6 is a perspective view of a slider sub-assembly formed in accordance with an embodiment.

FIG. 6 is a perspective view of a slider sub-assembly 180. The slider sub-assembly 180 includes the slider latches 116, the disengage sliders 118, the discharge mechanism 170, and one of the cartridge spacers 160, among other components. The slide sub-assembly 180 may be housed in the cavity 112 (shown in FIG. 5) of the cartridge 104 (shown in FIG. 5).

In the illustrated embodiment, the disengage sliders 118*a*, 118*b* extends along opposite sides of the slider sub-assembly 180. The disengage sliders 118 may be stamped and formed structures that are joined to one another. The cartridge spacer 160 joins the disengage sliders 118 to one another at a distal end 181. The disengage sliders 118 are operably coupled to the discharge mechanism 170 at a proximal end 183. Thus, the disengage sliders 118 move at the same time when the discharge mechanism 170 is activated. The disengage sliders 118 are coupled to each of the slider latches 116 such that the disengage sliders 118 force each of the slider latches 116 to move from a latched position to a discharge position to eject each of the connector modules 106 (shown in FIG. 1).

Each of the slider latches 116 has a profiled groove 182 configured to latchably receive the cam 152 (shown in FIG. 3) of the connector module 106 (shown in FIG. 3) to secure the connector module 106 to the cartridge 104 (shown in FIG. 5). Each of the slider latches 116 also has a biasing member 184 biasing the corresponding slider latch 116 in a biasing direction indicated by the arrow A along the longitudinal axis 158. The biasing member 184 forces the slider latch 116 to return to the latched position after the cam 152 (shown in FIG. 3) is received in the profiled groove 182.

The disengage sliders 118 cause the cam 152 to be released from the profiled groove 182 when the disengage sliders 118 are caused to move. The disengage sliders 118 are operably coupled to the ejector button 172. A return spring 173 is coupled to the ejector button 172 and abuts the cartridge spacer 160 (shown in FIG. 5) at the proximal end 183. The return spring 173 applies a bias force on the disengage sliders 118 to return the disengage sliders 118 to the latched position, as discussed below.

Figure 7:
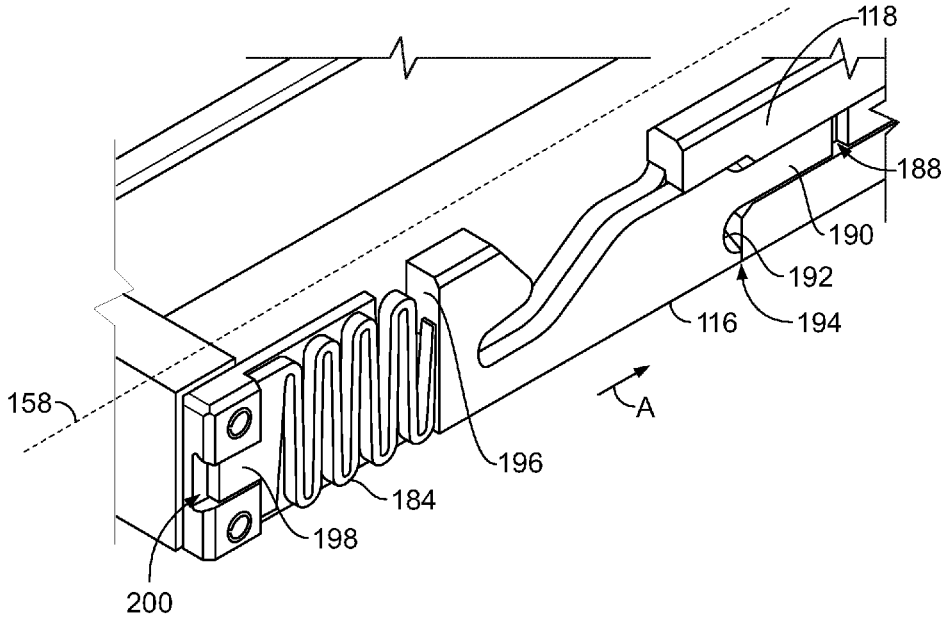
FIG. 7 is an enlarged perspective view of a slider latch and a disengage slider formed in accordance with an embodiment.

FIG. 7 is an enlarged perspective view of one of the slider latches 116 and the disengage slider 118. The slider latch 116 is coupled to the disengage slider 118 such that the slider latch 116 may move independently of the disengage slider 118.

The disengage slider 118 includes a first channel 188 configured to receive a tail portion 190 of the slider latch 116. In an exemplary embodiment, the first channel 188 receives the tail portion 190 in a dove-tail arrangement. The first channel 188 allows the tail portion 190, and hence the slider latch 116, to translate in the direction of the longitudinal axis 158.

A contact surface 192 on the disengage slider 118 abuts a stopper 194 on the slider latch 116 to limit the movement of the slider latch 116 in the direction along the longitudinal axis 158 indicated by the arrow A.

The connector module 106 and the cartridge 104 may create or provide an indication when the cam 152 is secured and captured in the profiled groove 182. In an exemplary embodiment, the stopper 194 is configured to produce an audible indication when the stopper 194 contacts the contact surface 192 to indicate that the cam 152 is secured in the profiled groove 182. However, in other embodiments, other components may produce the audible indication. Additionally or optionally, the cartridge 104 and connector module 106 may provide a visual indication. For example, the housing 122 may include a marking that is covered or hidden by the alignment surface 156 when the connector module 106 is secured within the cartridge 104. Indicators may be provided when the connector module 106 is unlocked, unlatched and/or removed.

The biasing member 184 applies a biasing force on the slider latch 116 in the direction A. The biasing member 184 abuts a rear surface 196 of the slider latch 116. The biasing member 184 includes a tail portion 198 received in a second channel 200 of the disengage slider 118. In an exemplary embodiment, the first and second channels 188, 200 allow the biasing member 184 and the slider latch 116 to be held in place in the disengage slider 118 while the slider sub-assembly 180 is assembled and/or inserted into cartridge 104 (shown in FIG. 5).

Figure 8:
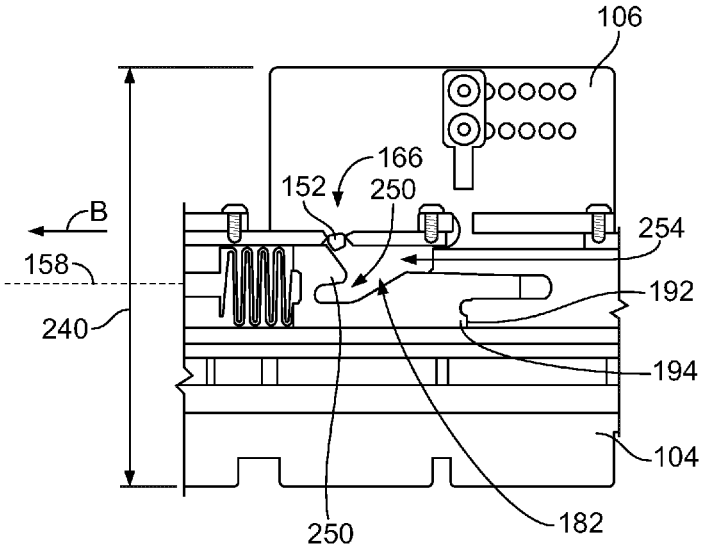
FIG. 8 is a side cross-sectional view of a cam engaging a slider latch formed in accordance with an embodiment.
Figure 9:
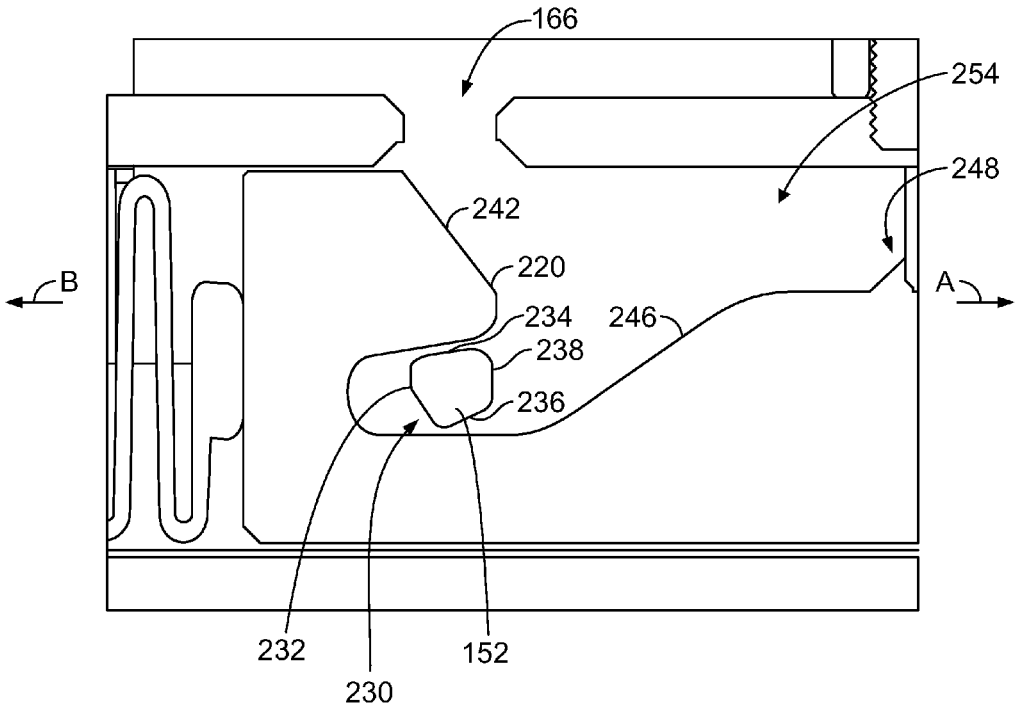
FIG. 9 is a side cross-sectional view of a slider latch capturing a cam formed in accordance with an embodiment.

FIG. 8 is a side cross-sectional view of the cam 152 engaging the slider latch 116. FIG. 9 is a side cross-sectional view of the slider latch 116 capturing the cam 152. FIGS. 8 and 9 illustrate the interaction of the cam 152, the slider latch 116, and the disengage slider 118.

In an exemplary embodiment, the cam 152 includes a profiled cam surface 230. The profiled cam surface 230 has a plurality of flat surfaces that are angled with respect to one another. In an exemplary embodiment, the angled surfaces are angled at non-orthogonal angles. The angled surfaces correspond to surfaces of the profiled groove 182 to control movement of the cam 152 along the profiled grooves 182 as the connector module 106 is being plugged into the cartridge 104 and as the connector module 106 is being ejected from the cartridge 104.

In an exemplary embodiment, the cam 152 includes a first inclined surface 232, a second inclined surface 234, and third inclined surface 236 and a fourth inclined surface 238. The cam 152 may include other inclined surfaces in addition to the incline surfaces 232-238. The inclined surfaces 232-238 are configured to engage different portions of the profiled grove 182 as the slider latch 116 is moved between the latched position and the discharge position.

In the illustrated embodiment, the profiled grove 182 includes a plurality of inclined surfaces that are configured to guide the cam 152 into and out of the cavity 112. However, in other embodiments, the profiled groove 182 may not include the inclined surfaces. In an exemplary embodiment, the connector module 106 and cam 152 move linearly along a plug/unplug axis 240 while the slider latch 116 moves linearly along the longitudinal axis 158. During plugging of the connector module 106 into the cartridge 104, the cam 152 drives the slider latch 116 along the longitudinal axis 158 in the direction B. To remove the connector module 106, the slider latch 116 is moved along the longitudinal axis 158 in the direction A to drive the cam 152 out of the cavity 112.

In the illustrated embodiment, the profiled groove 182 includes a first inclined surface 242, a second inclined surface 244, and third inclined surface 246, and a fourth inclined surface 248. In an exemplary embodiment, the disengage slider 118 (best shown in FIG. 7) also includes the inclined surfaces 242-248 that follow the contour of the inclined surfaces 242-248 on the slider latch 116. During plugging of the connector module 106 into the cartridge 104, and during ejection of the connector module 106 from the cartridge 104, the first inclined surface 232 of the cam 152 is configured to interact with the first inclined surface 242 of the profiled grove 182. Similarly, the second inclined surface 234 interacts with the second inclined surface 244, the third inclined surface 236 interacts with the third inclined surface 246 and the fourth inclined surface 238 interacts with the fourth inclined surface 248. The first inclined surfaces 232, 242 have similar angles. Similarly, the second inclined surfaces 234, 244 have similar angles; the third inclined surfaces 236, 246 have similar angles; and the fourth inclined surfaces 238, 248 have similar angles.

During mating of the connector module 106 with the cartridge 104, the cam 152 is loaded through the cutouts 166 until the cam 152 engages the slider latch 116. The first inclined surface 232 engages the first inclined surface 242. The cam 152 slides along the profiled grooves 182. The cam 152 drives the slider latch 116 to a clearance position at which the cam 152 clears a blocker 220. The cam 152 is then loaded into a latching area 250 of the corresponding profiled grooves 182. The latching area 250 is located under the blocker 220. The latching area 250 is defined, at least in part by the second inclined surface 244 of the profiled groove 182. In an exemplary embodiment, the second inclined surface 244 has a slight angle 252 with respect to the longitudinal axis 156, such as approximately 10°. The angle 252 of the second inclined surface 244 helps draw the connector module 106 into the cartridge 104. For example, the second inclined surface 244 forces the cam 152 downward as the slider latch 116 is driven to the latched or resting position. The cam 152 may provide an audible indication when the cam is 152 secured within the profiled groove 182.

During ejection, the discharge mechanism 170 (shown in FIG. 5) is caused to move in the direction B, which drives the slider latch 116 from the latched or resting position to the discharge position. As the slider latch 116 is moved in the direction B, the third inclined surface 246 is driven into the third inclined surface 236 of the cam 152. The cam 152 slides along the profiled groove 182. The cam 152 and the connector module 106 are driven outward (e.g. in an upward direction). The cam 152 is driven to a holding area 254 of the profiled groove 182. In the holding area 254, the cam has not been fully ejected. The cam 152 is clear of the blocker 220 in the holding area 254 and the connector module 106 can be manually pulled out of the cartridge 104. The cam 152 is driven to the holding area 254 when the discharge mechanism 170 is fully driven. When the slider latch 116 is in the unlatched position, the cam 152 is in the holding area 254 and is no longer blocked by the blocker 220.

Once the connector module 106 is released, the slider latch 116 is forced in the direction B by the discharge mechanism 170. As the slider latch 116 is moved from the discharge position toward the latched or resting position, the stopper 194 abuts the contact surface 192 (both shown in FIG. 8) creating an audible indication. Additionally, as the slider latch 116 is moved toward the resting position, the blocker 220 engages the cam 152. The blocker 220 is positioned inward of the holding area 254 to ensure that the cam 152 does not move back into the latching area 250, but rather is moved into an ejection area 256 and ultimately is ejected out of the cavity 112. The first inclined surface 242 engages the first inclined surface 232. The blocker 220 forces the cam 152 outward and fully ejects the cam from the cavity 112. As such, the ejection is a two stage ejection process. The first stage is accomplished with moving the slider latch 116 from the latched or resting position to the discharge position. The second stage is accomplished when the slider latch 116 moves from the discharge position to the latched position.

Figure 10:
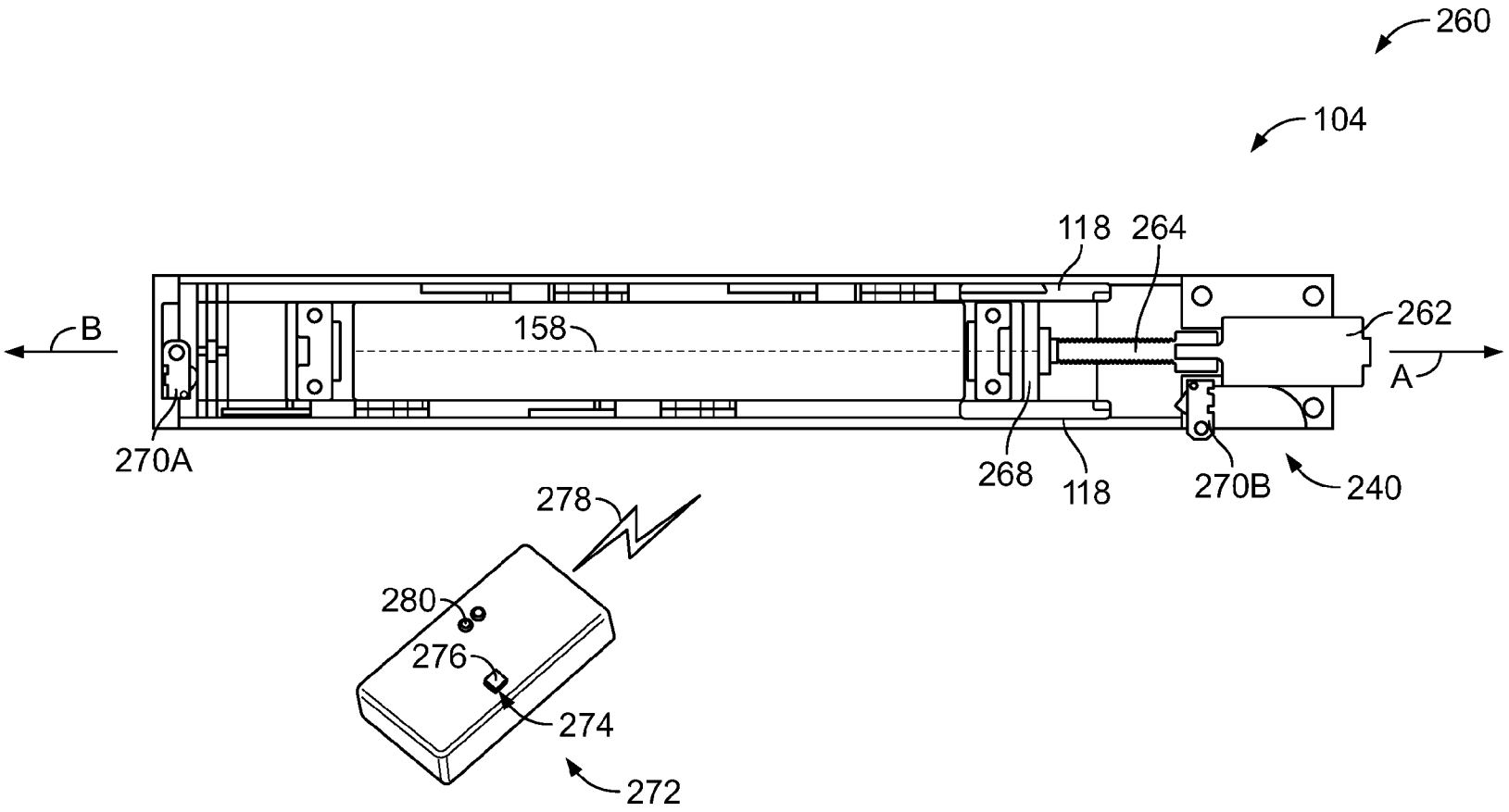
FIG. 10 is a top view of a cartridge having an electrical discharge mechanism formed in accordance with an embodiment.

FIG. 10 is a top view of the cartridge 104 having an electrical discharge mechanism 260. In the illustrated embodiment, the cartridge 104 is shown with the top shell 126 (shown in FIG. 5) removed. In an exemplary embodiment, the discharge mechanism 170 (shown in FIG. 5) is configured as an electrical discharge mechanism (EDM) 260. In the exemplary embodiment, the discharge mechanism 170 does not include the ejector button 172 (shown in FIG. 5). Instead, an electrical motor module 262 is coupled to the disengage sliders 118. Such a discharge mechanism 170 is referred to herein as the EDM 260. The electrical motor module 262 is configured to cause the disengage sliders 118 to move to eject the connector modules 106 from the cartridge 104.

The EDM 260 includes a jackscrew 264 coupled to a driver bar 268. The driver bar 268 extends laterally generally perpendicular to the longitudinal axis 158 and is coupled to the disengage sliders 118 on opposite sides of the opening 164. The driver bar 268 moves along the longitudinal axis 158. When the jackscrew 264 is driven, the jackscrew 264 causes the driver bar 268, and hence the disengage sliders 118 to move. Accordingly, the disengage sliders 118 may be caused to move from the discharge position to the latched position and vice versa.

The electrical motor module 262 is configured to drive the jackscrew 264. In an exemplary embodiment, the electrical motor module 262 is powered using direct current (DC), however, in other embodiments, the electrical motor module 262 may be powered using alternating current (AC).

The EDM 260 may include at least one limit switch 270. In an exemplary embodiment, the EDM 260 includes limit switches 270*a* and 270*b*. The limit switches 270 may be any type of switches capable of being triggered or actuated when a portion of the disengage sliders 118 abuts the switch contact. For example, the limit switches 270 may be spring-loaded momentary switches. The limit switch 270*a* is configured to actuate when the disengage sliders 118 reach the latched position. The limit switch 270*b* is configured to actuate when the disengage sliders 118 reach the discharge position.

The electrical motor module 262 may drive the jackscrew 264 to cause the disengage sliders 118 to move. For example, the electrical motor module 262 may cause the disengage sliders 118 to move in the direction B until the disengage sliders 118 actuate the limit switch 270*a*. Similarly, the electrical motor module 262 may cause the disengage sliders 118 to move in the direction A until the disengage sliders 118 actuate the limit switch 270*b*. In other embodiments, other position detection components may be used. For example, optical sensors may be used to determine the position of the disengage sliders 118.

In an exemplary embodiment, the EDM includes a control box 272 having a control interface 274 configured to energize the electrical motor module 262 on demand. For example, the control interface 274 may be used to eject the connector modules 106 (shown in FIG. 1) when a button 276 is pressed. The control box 272 may be communicatively coupled to the electrical motor module 262 via a wireless link 278, but in other embodiments other links may be used, such as a wired link. The control interface 274 may include at lest one indicator status lights 280. The indicator status lights 280 may be illuminated when electrical motor module 262 is being driven. In other embodiments, other arrangements are possible. For example, the control box 272 may be embodied as a computing device, a mobile and/or the like. For example, the mobile device may be a mobile phone, mobile computer and/or the like.

Figure 11:
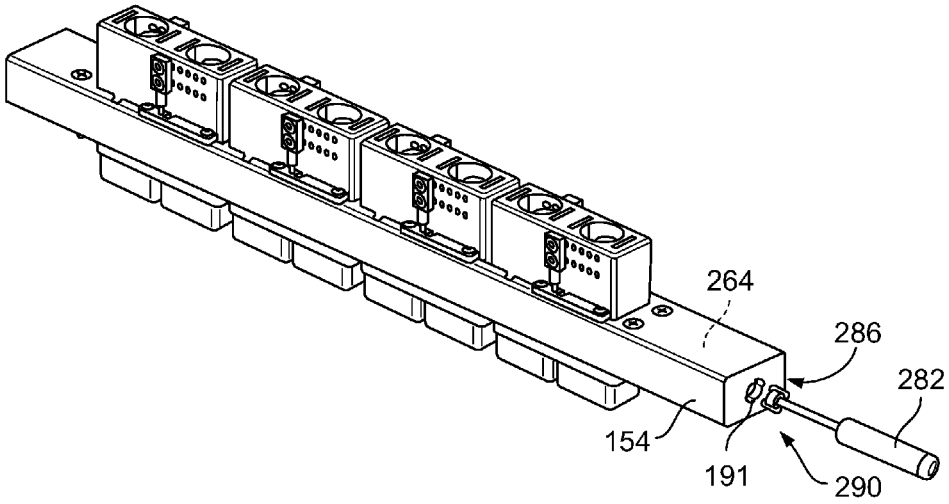
FIG. 11 is a perspective view of a cartridge having a manually rotatable discharge mechanism formed in accordance with an embodiment.

FIG. 11 is a perspective view of the cartridge 104 having a manually rotatable discharge mechanism 286. In various embodiments, the discharge mechanism 286 may be configured to prevent tampering or inadvertent activation. For example, the discharge mechanism 286 may have a button configured to be locked or guarded to prevent the button from being depressed. In the illustrated embodiment, the discharge mechanism 170 (shown in FIG. 5) is configured to be actuated using an external driver tool 282. However, in other embodiments, other arrangements are possible. As such, the discharge mechanism 170 does not include the ejector button 172 (shown in FIG. 5), or the electrical motor module 262 (shown in FIG. 10). Such a discharge mechanism 170 is referred to herein as the manual discharge mechanism 286.

The manual discharge mechanism 28 includes the jackscrew 264 (shown in FIG. 10) and the driver bar 268 (shown in FIG. 10). In an exemplary embodiment, the jackscrew 264 is operably coupled to a driver head 290 instead of the electrical motor module 262 (shown in FIG. 10). A face of the driver head 290 extends through an opening 291 in the base mount 154. The driver head 290 is configured to be driven by the driver tool 282. The driver head 290 and the driver tool 282 may be complementary to one another. For example, the driver head 290 may have a depression configured to receive a portion of the driver tool 282. In an exemplary embodiment, the driver tool 282 and the driver head 290 have a selective pattern such that the driver head 290 will only receive, and is only compatible with the driver tool 282. As such, the manual discharge mechanism 286 may prevent unauthorized or inadvertent ejection of the connector modules 106 (shown in FIG. 3).

The driver tool 282 is manually rotated to cause the driver head 290, and hence the jackscrew 264 to rotate. When the jackscrew 264 is driven, the jackscrew 264 causes the driver bar 268, and hence the disengage sliders 118 to move. Accordingly, the disengage sliders 118 may be caused to move from the discharge position to the latched position and vice versa.

Figure 12:
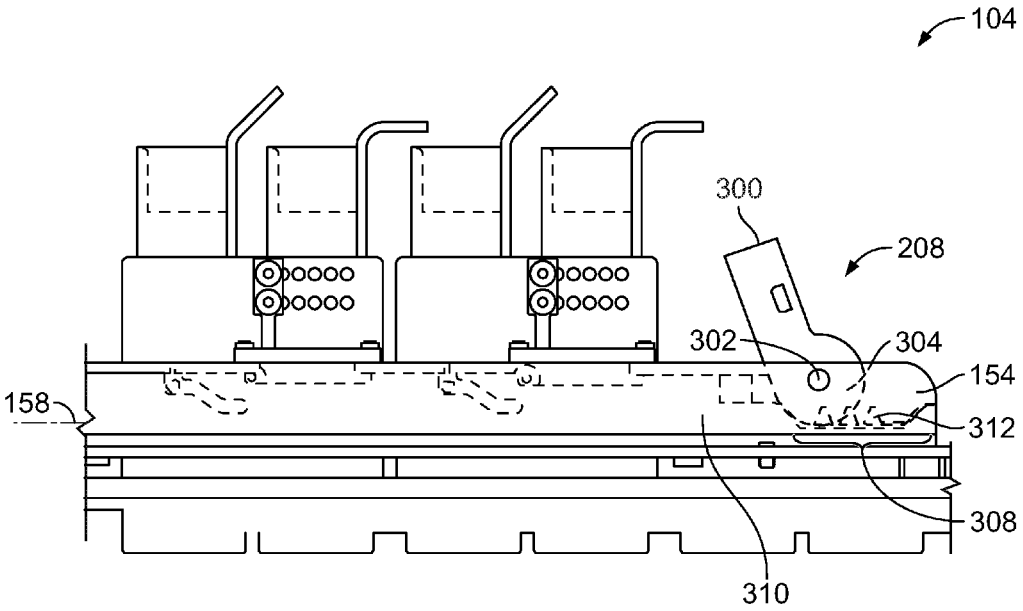
FIG. 12 is a cross-sectional side view of a cartridge having a levered discharge mechanism formed in accordance with an embodiment.

FIG. 12 is a cross-sectional side view of the cartridge 104 having a levered discharge mechanism 298. In the illustrated embodiment, the discharge mechanism 170 (shown in FIG. 5) is configured to be actuated by rotating a handle 300. As such, the discharge mechanism 170 does not include the ejector button 172 (shown in FIG. 5). Such a discharge mechanism 170 is referred to herein as the levered discharge mechanism 298.

The handle 300 includes a pivot axle 302 coupled to opposite sides of the base mount 154. The handle 300 is free to rotate or pivot about the pivot axle 302. The handle 300 includes a geared portion 304 circumferentially surrounding the pivot axle 302. In an exemplary embodiment, the handle 300 includes the geared portion 304 on both sides of the pivot axle 302. The geared portions 304 are configured to engage linear gear portions 308 on a portion of each disengage slider 310. The linear gear portions 308 include teeth 312 having a similar pitch as the geared portions 304 such that when the geared portions 304 are caused to rotate, the linear gear portions 308 move longitudinally in the direction of the longitudinal axis 158. The handle 300 may be rotated to cause the disengage sliders 310 to move from the resting position to the discharge position and vice versa.

Figure 13:
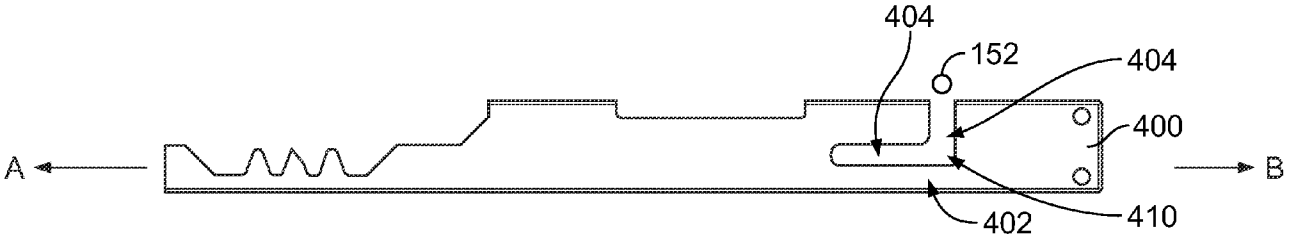
FIG. 13 is a side view of a disengage slider having a profiled groove formed in accordance with an embodiment.

FIG. 13 is a side view of a disengage slider 400 having a profiled groove 402. In the illustrated embodiment, the slider latch 116 (shown in FIG. 5) is integrally formed with the disengage slider 400. As such, the connector system 100 does not include a separate slider latch 116. The disengage slider 400 is configured to engage the cam 152 (also shown in FIG. 3) to secure the connector module 106 (shown in FIG. 1) to the cartridge 104 (shown in FIG. 1). In the illustrated embodiment, the profiled groove 402 does not include the inclined surfaces 232-238 (shown in FIG. 9). Instead the profiled groove 402 includes a vertical slot 404 and a horizontal slot 408. In operation, when the connector module 106 (shown in FIG. 1) is loaded into the cartridge 104 (shown in FIG. 1), the cam 152 is received in the vertical slot 404 and travels along the vertical slot 404 to a staging position 410 at the bottom of the vertical slot 404. The disengage slider 400 is caused to be moved in the direction B to cause the cam 152 to travel into and along the horizontal slot 408. The cam 152 is then held in the horizontal slot 408 to secure the connector module 106 to the cartridge 104. When the connector module 106 is ejected from the cartridge 104, the disengage slider 400 is moved in the direction A until the cam 152 is then moved to staging position 410. The connector module 106 is the pulled or removed from the cartridge 104.

Figure 14:
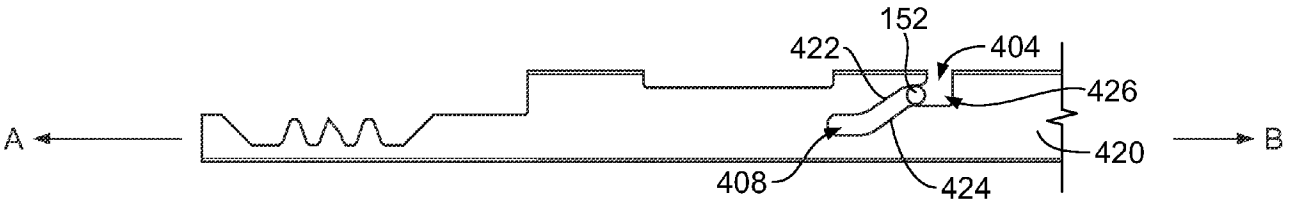
FIG. 14 is a side view of a disengage slider configured to eject a connector module formed in accordance with an embodiment.

FIG. 14 is a side view of a disengage slider 420 configured to eject the connector module 106 (shown in FIG. 1). In the illustrated embodiment, the slider latch 116 (shown in FIG. 5) is integrally formed with the disengage slider 400. As such, the disengage slider 420 includes an upper inclined surface 422 and a lower inclined surface 424 both extending between the vertical slot 404 and the horizontal slot 408. When the connector module 106 (shown in FIG. 1) is loaded into the cartridge 104 (shown in FIG. 1), the cam 152 is received in the vertical slot 404 and travels along the vertical slot 404 to a staging position 426. The disengage slider 420 is then moved in the direction B to cause the cam 152 to slide along the upper inclined surface 422 which pulls the connector module 106 downward into the cartridge 104 (shown in FIG. 1). During ejection, the disengage slider 420 is moved in the direction A. The cam 152 exits the horizontal slot 408 and slides along the lower inclined surface 424. As such, the disengage slider 420 lifts the connector module 106 out of the cartridge 104.

Figure 15:
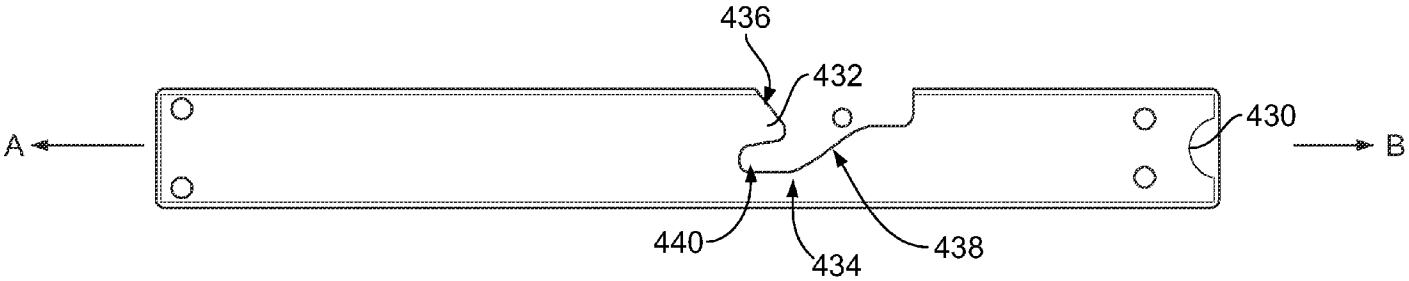
FIG. 15 is a side view of a disengage slider having a blocker formed in accordance with an embodiment.

FIG. 15 is a side view of a disengage slider 430 having a blocker 432. In the illustrated embodiment, the slider latch 116 (shown in FIG. 5) is integrally formed with the disengage slider 430. The disengage slider 430 include a profiled groove 434 having inclined surfaces 436 and 438. The disengage slider 430 may be spring loaded or biased in the direction B. When the connector module 106 (shown in FIG. 1) is loaded into the cartridge 104 (shown in FIG. 1), the cam 152 slides along the inclined surface 436. The disengage slider 430 moves in the direction A as the cam 152 slides along the inclined surface 436. The cam 154 is then loaded in a latching area 440 under the blocker 432. When the connector module 106 is ejected, the disengage slider is caused to be moved in the direction A. The cam 152 slides along the inclined surface 438 to lift the connector module 106 out of the cartridge 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f) unless and until such claim limitations expressly use the phrase "means for" followed by a statement of function void of further structure.

What is claimed is:

1. A connector system comprising:

a cartridge having at least one cavity configured to hold connector modules therein, the cartridge having at least one port therein, the cartridge receiving the connector modules through the corresponding at least one port;

at least one slider latch housed in the cartridge, the at least one slider latch being movable in a longitudinal direction and having at least one profiled groove configured to latchably receive a cam of the corresponding connector module to secure the connector modules to the cartridge, wherein the at least one slider latch has a biasing member operably coupled thereto, the biasing member biasing the at least one slider latch in a biasing direction, the biasing member forcing the at least one slider latch to return to a latched position after the cam is received in the profiled groove;

at least one disengage slider operable on the corresponding slider latch, movement of the disengage slider forces the slider latch to move from the latched position to a discharge position to release the cam from the corresponding profiled groove to eject each of the connector modules from the cartridge; and a discharge mechanism configured to move the at least one disengage slider.

2. The connector system of claim 1, wherein the discharge mechanism includes an ejector button operatively coupled to the disengage slider to move the disengage slider when the ejector button is pressed.

3. The connector system of claim 1, wherein the discharge mechanism includes a manual discharge mechanism operably coupled to the disengage slider, the manual discharge mechanism configured to move the disengage slider.

4. The connector system of claim 1, wherein the discharge mechanism includes an electrical discharge mechanism operably coupled to the disengage slider, the electrical discharge mechanism configured to move the disengage slider.

5. The connector system of claim 4, wherein the electronic discharge mechanism includes a control box having a control interface configured to energize the discharge mechanism on demand.

6. The connector system of claim 1, wherein the discharge mechanism includes a rotatable handle having a geared portion circumferentially surrounding a pivot axle extending through the cartridge, the geared portion engaging a corresponding linear gear portion of the disengage slider such that rotation of the handle causes the disengage slider to move from the resting position to the discharge position.

7. The connector system of claim 1, wherein the cartridge further comprises a keyway configured to receive a harness key coupled to the connector module, the harness key and the keyway governing access to the port by the connector module.

8. The connector system of claim 7, wherein the connector module further comprises a housing having one or more stations, the harness key being reconfigurably attached to the one or more stations.

9. The connector system of claim 7, wherein the connector module further comprises a housing having a top shell and a bottom shell, the harness key comprising a top harness key coupled to the top shell, a bottom harness key being coupled to the bottom shell.

10. The connector system of claim 1, wherein the cartridge and the connector module create an indication when the cam is secured within profiled groove.

11. The connector system of claim 1, wherein the profiled groove includes a latching area in which the cam is captured to secure the connector module, the profiled groove including a first inclined surface engaging the cam and ejecting the connector module from the cartridge when the slider latch moves from the discharged position to the latched position.

12. The connector system of claim 1, wherein the profiled groove includes a latching area in which the cam is captured to secure the connector module, the profiled groove includes an ejection area from which the cam is ejected from the profiled groove as the slider latch is moved to the unlatched position, the cam being moved from a holding area to the ejection area and then being ejected from the profiled groove as the discharge mechanism is activated.

13. The connector system of claim 1, wherein the profiled groove include a blocker between a latching area and an ejection area, the profiled groove including an inclined surface extending along the ejection area, the blocker stopping the cam from returning to the latching area and the inclined surface forcing the cam to ride along the inclined surface.

14. A connector system comprising:

one or more connector modules having a housing including one or more stations configured to hold a harness key at a plurality of locations, a cartridge having at least one cavity configured to hold the connector modules therein, the cartridge having at least one port therein, the port having a keyway configured to receive the harness key, the cartridge receiving the connector modules through the corresponding at least one port;

at least one slider latch housed in the cartridge, the at least one slider latch being movable in a longitudinal direction and having at least one profiled groove configured to latchably receive a cam of the corresponding connector module to secure the connector module to the cartridge, wherein the at least one slider latch has a biasing member operably coupled thereto, the biasing member biasing the at least one slider latch in a biasing direction, the biasing member forcing the at least one slider latch to return to a latched position after the cam is received in the profiled groove;

at least one disengage slider operably connected to the corresponding slider latch, movement of the disengage slider forces the slider latch to move from the latched position to a discharge position to release the cam from the corresponding profiled groove to eject each of the connector modules from the cartridge; and a discharge mechanism configured to move the disengage slider.

15. The connector system of claim 14 wherein the harness key is reconfigurably attached to the one or more stations.

16. The connector system of claim 14 wherein the harness key and the keyway govern access to the port by the connector module.

17. The connector system of claim 14 wherein the housing further comprises a top shell and a bottom shell, the harness key comprising a top harness key coupled to the top shell and a bottom harness key coupled to the bottom shell.

18. A connector system comprising:

a cartridge having at least one cavity configured to hold connector modules therein, the cartridge having at least one port therein, the cartridge receiving the connector modules through the corresponding at least one port;

at least one slider latch housed in the cartridge, the at least one slider latch being movable in a longitudinal direction and having at least one profiled groove configured to latchably receive a cam of the corresponding connector module to secure the connector modules to the cartridge, wherein the at least one slider latch has a biasing member operably coupled thereto, the biasing member biasing the at least one slider latch in a biasing direction, the biasing member forcing the at least one slider latch to return to a latched position after the cam is received in the profiled groove;

wherein the profiled groove includes a latching area in which the cam is captured to secure the connector module, the profiled groove includes inclined surfaces to guide the cam into the groove;

a disengage slider operably connected to a corresponding slider latch, movement of the disengage slider forces the slider latches to move from the latched position to a discharge position to release the cam from the corresponding profiled groove to eject each of the connector modules from the cartridge; and a discharge mechanism configured to move the disengage slider.

19. The connector system of claim 18 wherein the cam and the profiled groove create an indication when the cam is secured within profiled groove.

20. The connector system of claim 18 wherein the profiled groove include a blocker between the latching area and an ejection area, the inclined surface extending along the ejection area, the blocker stopping the cam from returning to the latching area and the inclined surface forcing the cam to ride along the inclined surface.

* * * * *